United States Patent [19]

Rueckl

[11] Patent Number: 4,599,142

[45] Date of Patent: Jul. 8, 1986

[54] COKE OVEN DOOR LINING

[75] Inventor: Roger L. Rueckl, Washington Township, Westmoreland County, Pa.

[73] Assignee: United States Steel Corporation, Pittsburgh, Pa.

[21] Appl. No.: 688,468

[22] Filed: Jan. 3, 1985

[51] Int. Cl.[4] ..... C10B 25/04

[52] U.S. Cl. ..... 202/242; 110/173 R; 202/247

[58] Field of Search ..... 202/242, 248, 268, 269, 202/247; 110/173 R, 180, 181; 264/30

[56] References Cited

U.S. PATENT DOCUMENTS

| | | | |
|---|---|---|---|
| 3,448,475 | 6/1969 | Stanke | 15/93 A |
| 4,028,193 | 6/1977 | Nagayoshi | 202/248 |
| 4,107,244 | 8/1978 | Ochiai et al. | 264/30 |
| 4,186,055 | 1/1980 | Baird et al. | 202/248 |

*Primary Examiner*—Donald Czaja
*Assistant Examiner*—J. E. Cabaniss
*Attorney, Agent, or Firm*—William F. Riesmeyer, III

[57] ABSTRACT

A construction for the refractory lining member of a coke oven door is provided. The coke oven door lining includes a generally "U"-shaped frame with a castable refractory element formed therein. The frame is provided with a base portion and first and second legs which extend from the base. A series of diagonal cross-members are provided to be affixed at one end to the ends of the legs and at the other end to the central region of the base portion. The refractory member is formed from a castable refractory material and is designed to extend beyond the ends of the legs of the frame. In an alternative embodiment of the invention, the refractory member consists of a two-layer system to provide greater insulation.

10 Claims, 6 Drawing Figures

COKE OVEN DOOR LINING

The present invention relates to a refractory lined door for an oven or furnace and, in particular, to a coke oven door which employs a castable refractory door lining or plug.

In the commercial production of coke, a series of vertical oven chambers are typically arranged in side-by-side relation to form a coke oven battery. Each such coke oven is provided with a pair of primarily metallic doors; one on the side of the coke battery where a pushing machine is introduced to push the coke from the oven, and another on the opposite side of the oven to allow the coke to be removed therefrom.

As will be readily appreciated, the temperatures required to transform coal to coke are quite high, generally over 1800° F. In order to prevent emissions from the coke oven to the atmosphere, the coke oven doors are usually constructed to close tolerances to assure a tight fit to the oven. Obviously, if any damage due to the excessive temperatures or due to any other cause were present, the close fit would be lost and fugitive emissions would result. In order to protect the metal coke oven door and its sealing member and to prevent an excessive amount of heat from escaping from the coke oven doors, a refractory material is generally used to insulate the door.

In the past, the method of constructing coke oven doors usually included the setting of refractory bricks within a frame on the coke oven door by a bricklayer. As may be appreciated, the cost of constructing such coke oven doors is excessive due to the high cost of the specialized brick which could not be standardized and the skilled labor required for their installation. One example of a coke oven door of this type appears in U.S. Pat. No. 4,186,055. Another example of brick door construction appears in U.S. Pat. No. 3,343,193. However, the latter design incorporates a "picture-frame" type refractory retainer as opposed to the full back plate of U.S. Pat. No. 4,186,055. In addition to the high labor and material costs associated with these designs, such refractory retainers are especially costly as they are typically formed of cast iron or by roll forming of heavy gauge plate material.

Certain of those in the coking industry pursued the use of a castable refractory substance for use in coke oven doors to avoid certain problems presented by doors using brick refractories. U.S. Pat. No. 3,298,930 teaches of such a coke oven door construction. In order to affix the castable refractory material to the coke oven door in such a design, a plurality of anchors were typically used between the door frame and the castable refractory. Such anchors proved relatively costly to install and often diminished the structural integrity of the castable refractory. Further, as will be described below, carbon buildup on the refractory surfaces of such a coke oven lining has proven most harmful to door sealing and quite difficult to effectively remove.

During the transformation of coal to coke a great amount of hydrocarbon gases are given off by the coal. Such gases can cause carbon to accumulate on the surfaces of the coke oven door which are located within the coke oven, namely, the refractory and its retaining frame. This deposit of carbon is particularly harmful as it quickly grows to a thickness which interferes with the close tolerance fit of the coke oven door within the oven. Of course, when the door is not able to fit properly within the coke oven, gaps occur around the sealing surface which provide an avenue for emissions to escape to the atmosphere.

Removal of the carbon buildup from the refractory material used in a coke oven door lining is most difficult. From above, this problem is particularly acute with respect to previous door linings using castable refractory. The carbon forms a hard surface on the refractory surface with a continuous network of carbon being formed within the pores of the door refractory. Typical means of attempting to remove the carbon buildup necessitate the removal of the door from service for an extended period of time so that the carbon may be chipped, to the extent possible, away from the refractory. Obviously, the removal of the door from service requires a slowing of the coking process which, in turn, causes a costly delay in production, and hence, reduced output from the coke oven. In addition, the chipping of carbon from the refractory is labor intensive and is not usually completely effective to remove the carbon while nevertheless causing serious damage to the refractory itself.

The subject invention is directed toward an improved coke oven door refractory construction which overcomes, among others, the above-discussed problems and provides a cost effective refractory lining construction which is effective in insulating a coke oven door, but from which carbon is readily removable thereby obviating the necessity of removing the coke oven from service during the cleaning of the door lining.

SUMMARY OF THE INVENTION

In accordance with the present invention, there is provided a construction for the refractory lining or plug of a coke oven door. The door plug structure includes a generally "U"-shaped metallic frame for retaining a castable refractory lining. The frame consists of a flat base portion and first and second legs extending therefrom. The end portions of such legs are configured to be turned inwardly to retain the refractory therebetween. In addition, bracing bars are provided to extend from the ends of the leg portions to the intermediate area of the base portion. A castable refractory member is formed within the frame member and is provided to extend beyond the ends of the leg members and into the coke oven when in operation. As such, the bracing members serve to retain the leg members in the proper clearance relation with respect to the coke oven and to secure the castable refractory to the frame. It is notable that the frame member of the present invention may be formed of light to heavy gauge plate material thereby achieving material cost savings over the prior art designs.

In an alternative embodiment of the invention, the refractory member may consist of a two layer system. In such a configuration, the layer in contact with the base portion of the frame may consist of a more insulating, and hence, less durable refractory material while the other layer will be formed of a standard refractory substance.

In operation, the coke oven door refractory system disclosed herein provides the ability to use castable refractory material which is more cost-efficient due to its easier applicability while providing a more readibly cleanable door lining structure. From above, the cleanability of the door lining is crucial to an effective design due to the high costs associated with the production delays and labor intensive cleaning practices of the prior art designs. This latter point is made possible due to the fact that the area of principal concern as regards carbon buildup is the side area of the refractory. In the present invention, the metallic leg portions substantially cover the sides of the refractory. As such, the legs may simply be scraped at any time the door is removed from the oven, for example while pushing coke, with a long-handled, flat-bladed scraper rather than removing the door from service and attempting to chip the carbon from the castable refractory as is done currently.

Accordingly, the present invention provides solutions to the aforementioned problems present with previous coke oven door refractory constructions. As this invention provides an effective, cost-efficient structure for retaining the refractory lining used in a coke oven door while assuring ready cleanability of the door system, the problems caused by excessive carbon buildup are alleviated. As such, the production of coke by the coke oven need not be interrupted to perform routine door maintenance.

Those and other details, objects and advantages of the present invention will become apparent as the following description of the present preferred embodiment thereof proceeds.

BRIEF DESCRIPTION OF THE DRAWINGS

In the accompanying drawings, I have shown a present preferred embodiment of the invention wherein.

DETAILED DESCRIPTION OF THE INVENTION

Figure 1:
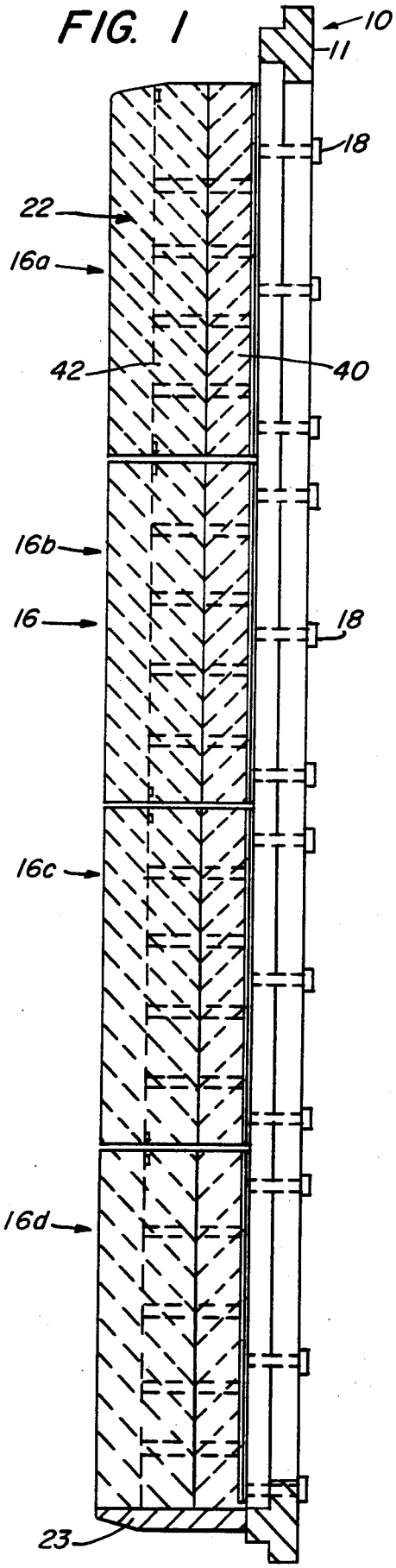
FIG. 1 is a side section view, taken along line I—I in FIG. 2, of a portion of a coke oven door provided with the door lining construction disclosed herein.

Referring now to the drawings wherein the showings are for purposes of illustrating the present preferred embodiments of the invention only and not for purposes of limiting the same, the figures show an elongated, metallic coke oven door, generally 10, the frame portion of which is designated as 11, disposed within the end wall 12 of an elongated coke oven generally shown as 14.

Figure 2:
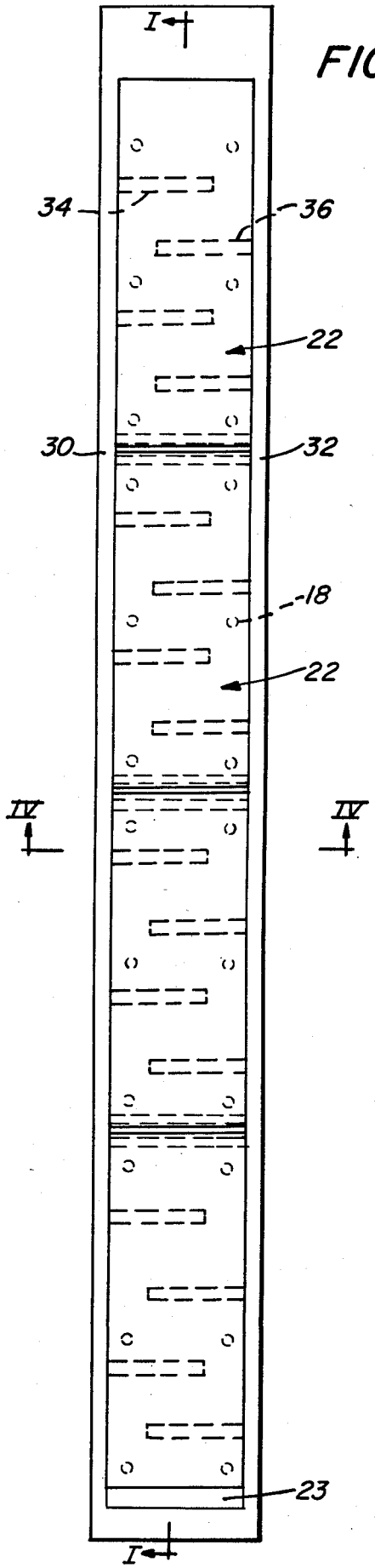
FIG. 2 is a front view of a coke oven door provided with the present coke oven door lining construction.

More particularly and with reference to FIG. 1, there is shown a refractory door plug system, generally 16, which is affixed to the coke oven door frame 11 by means of bolts 18 which pass through door frame 11 and into the frame 20 of door system 16. In the preferred embodiment of the present invention, door system 16 will actually comprise a series of distinct frame elements 20 and their accompanying refractory members 22 described below, affixed in end-to-end relation to one another to door frame 11. As such, FIGS. 1 and 2 depict a door system 16 having four (4) sections, 16*a*, 16*b*, 16*c* and 16*d*, respectively. A foot member 23 is preferably affixed to door frame 11 at the bottom portion thereof beneath the lowermost section 16*d* in order to protect the refractory 22 during insertion of door 10 into oven 14.

The discrete elements 16*a*, 16*b*, 16*c* and 16*d* of door system 16 each include a frame 20 and a refractory member 22. As elements 16*a* through d are most similar, only one section, 16*c*, will be described in detail herein. Frame member 20 may be constructed of light to intermediate gauge metal plate material and includes a flat base plate portion 26 the reverse side of which is in facing relation to coke oven door frame 11 and is adapted to receive bolts 18 secured therethrough.

Extending from base plate 26 on frame member 20 are first leg 30 and second leg 32. Legs 30 and 32 are affixed at one end thereof to base plate 26 while, in operation, the other ends thereof extend into coke oven 14. The free ends of legs 30 and 32 may be either parallel to one another and perpendicular to base plate 26 or slightly, at an angle of less than 15°, inclined toward one another in order to correspond to the shape of the end portion of coke oven 14 so as to allow ready insertion of door 10 into oven 14. While a preferred embodiment of the present invention contemplates that frame 20 consisting of back plate 26 and legs 30 and 32 will be formed from a single piece of plate material, it may also be desirable to construct frame 20 as follows. Base plate 26 may actually comprise two, preferably symmetrical sections, 26*a* and 26*b*, with section 26*a* supporting leg 30 and section 26*b* supporting leg 32. In such an embodiment, joint 33 will join the respective sections of frame 20. In addition, it will also be appreciated that base plate 26 may comprise one plate member with legs 30 and 32 consisting of separate plates affixed thereto. Such a construction is suitable for retrofitting coke oven door refractory systems which originally included only a backing plate with the refractory element anchored thereto. In order to accomplish such a retrofit, only the backing plate will be utilized while all other members are as provided herein.

Intermediate the top and bottom ends of section 16*c* in separated staggered orientation are bracing bar members 34 and 36. Braces 34 are provided to extend from and be affixed to the free end of leg 30 and the base plate 26, and preferably on the remote side of base plate 26 from leg 30 relative to the axis of symmetry of frame 20. Braces 36 are provided to extend from and be affixed to the free end of leg 32 and to the base plate 26 and preferably on the remote side of base plate 26 relative to the axis of symmetry of frame 20. As such, braces 34 and 36 serve to retain the ends of legs 30 and 32 while refractory 22 is formed therebetween and also to prevent carbon from building up between the refractory 22 and legs 30 and 32 which buildup would cause legs 30 and 32 to be bent outwardly thus interfering with the fit of door 10 within oven 14. Bar cross members 38 are preferably provided at the ends of each section 16*a*, 16*b*, 16*c* and 16*d*, except at the lowermost portion of section 16*d*, to add additional structural integrity and to positively retain the corner regions of each section of element 16.

Figure 4:
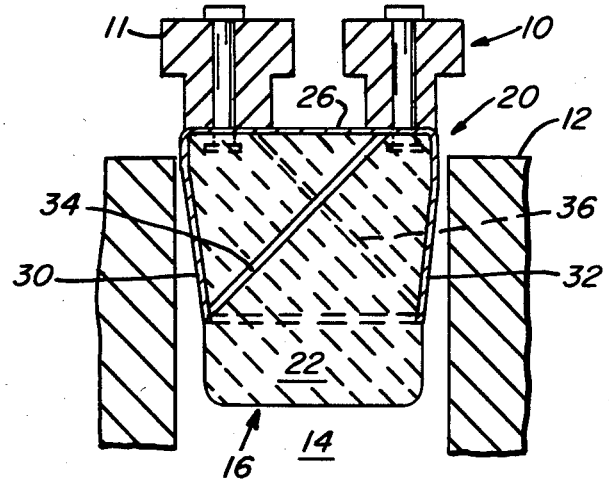
FIG. 4 is an end section view of the coke oven door system disclosed herein.
Figure 5:
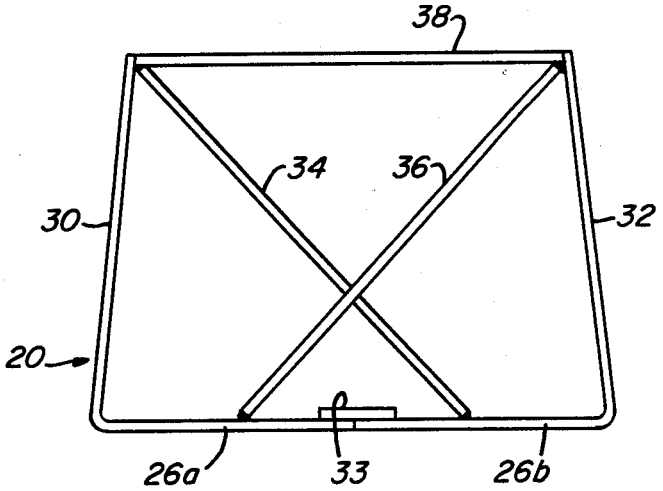
FIG. 5 is an end view of the frame member of the coke oven door lining retention system disclosed herein.
Figure 6:
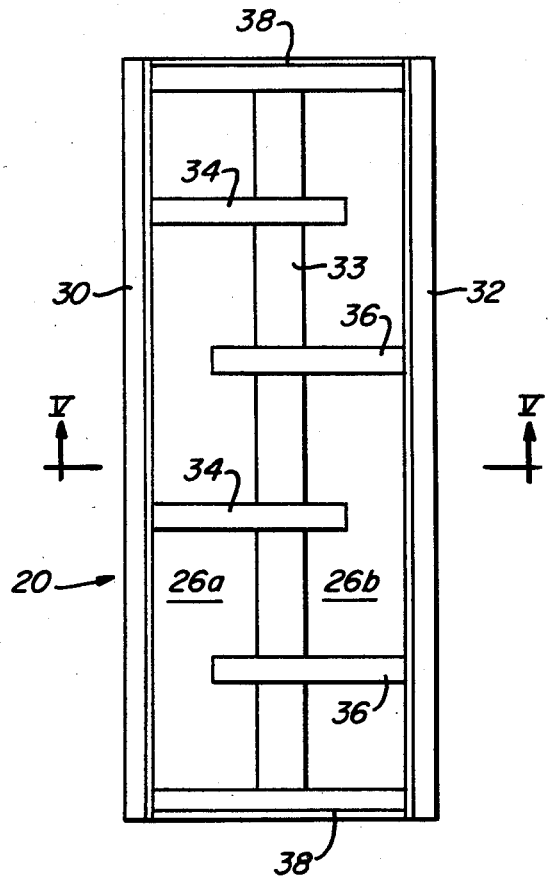
FIG. 6 is a front view of the frame member of the coke oven door lining retention system disclosed herein.

While the above description relates to the components of frame 20, the refractory element 22 will now be described in detail. In the embodiment depicted in FIG. 4, refractory 22 will consist of a suitable castable refractory substance that is formed within frame 20 and is provided to extend beyond legs 30 and 32. As such, it will be appreciated that diagonal braces 34 and 36 serve the additional function of anchoring and supporting castable refractory 22 on frame 20. Also, cross bars 38 provide an additional means of supporting and anchoring refractory 22 to frame 20.

Figure 3:
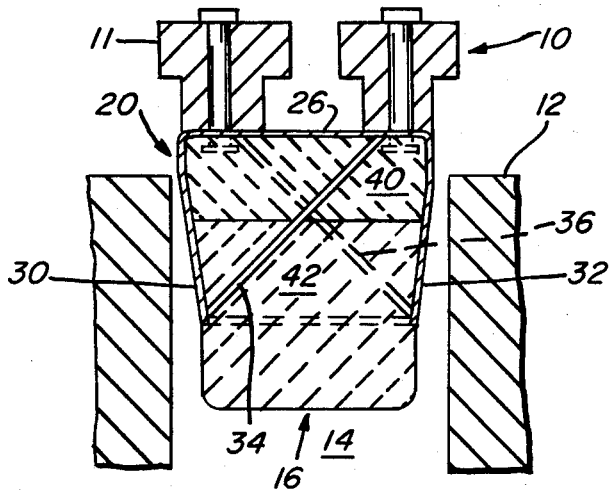
FIG. 3 is an end section view of an alternative embodiment of the coke oven door lining system of the present invention.

In an alternative embodiment of this invention, depicted in FIGS. 1 and 3, refractory element 22 may consist of a first castable refractory layer 40 and a second castable refractory layer 42. In such an embodiment, first refractory layer 40 will be formed between legs 30 and 32 and immediately adjacent backing plate 26. Second refractory layer 42 will be formed within the remainder of frame 20 and will extend beyond the ends of legs 30 and 32 the necessary depth into oven 14 to provide the required insulation characteristics. Preferably, first refractory layer 40 will be formed of a castable refractory material that possesses a high insulating capability. As such a castable refractory material is generally more porous and structurally weaker, it has been heretofore been impossible to use such a material in coke oven doors because any exposure thereof to carbon will cause a buildup that cannot be effectively removed. However, as the present door system 16 provides a can about such a refractory 40, it may be successfully employed. Second refractory layer 42 will preferably comprise a form of castable refractory that is typically used for coke oven door plugs. As such, the door system 16 which utilizes the refractory combination 40 and 42 will provide superior insulating characteristics which will result in a high degree of protection of the sealing assembly of the coke oven door, in fuel savings and improved productivity of the coke oven 14.

It will be understood that various changes in the details, materials and arrangements of parts which have been herein described and illustrated in order to explain the nature of the invention, may be made by those skilled in the art within the principle and scope of the invention as expressed in the appended claims.

What is claimed is:

1. A coke oven door lining construction in combination with an elongate coke oven door having a door frame, comprising:

(a) at least one elongated, generally "U"-shaped retaining frame affixed to said coke oven door frame and extending substantially the length thereof, said retaining frame comprising a flat base portion and first and second legs extending substantially perpendicular to said base portion and substantially parallel to one another;

(b) at least one first bracing bar affixed at one end thereof to the free end of said first leg and affixed at the other end to said base portion;

(c) at least one second bracing bar affixed at one end thereof to the free end of said second leg and affixed to the other end to said base portion;

(d) a refractory plug supported by said retaining frame and said first and second bracing bars and substantially filling said retaining frame, said refractory plug extending outwardly from said base portion beyond said first and second legs, said refractory plug comprising a castable refractory material.

2. The coke oven door lining construction of claim 1 further comprising a plurality of retaining frames having said first and second bracing bars affixed thereto and corresponding refractory plugs, said plurality of retaining frames being affixed in end-to-end relation to said door frame.

3. The coke oven door lining construction of claim 2 in which the ends of said first and second second bracing bars which are affixed to said base portion, are affixed thereto on the opposite sides of the axis of symmetry of said retaining frame than said first and second legs, respectively.

4. The coke oven door lining construction of claim 3 further comprising cross bars affixed between the corner regions of said first and second legs and perpendicular to said first and second legs.

5. The coke oven door lining construction of claim 4 in which said retaining frame is formed from a single metallic plate.

6. The coke oven door lining construction of claim 4 in which said retaining frame comprises two symmetrical sections, one section comprising one-half of said base portion and said first leg and the other section comprising one-half of said base portion and said second leg, said retaining frame further comprising an intermediate joint member effective to join the respective sections thereof.

7. The coke oven door lining construction of claim 4 in which said base section of said retaining frame and said first and said second legs all comprise discrete metallic plates which are joined to form said retaining frame.

8. The coke oven door lining construction of claim 4, 5, 6 or 7 in which said refractory plug comprises:

(a) a first refractory layer of insulating refractory material, said first layer being disposed between said first and second legs and adjacent said base portion; and (b) a second refractory layer of a harder refractory material than said first refractory layer, a portion of said second layer being disposed between said first and second legs and a portion of said second layer extending beyond said first and second legs and away from said base portion.

9. The coke oven door construction of claim 3, 5, 6 or 7 in which the ends of said first and second legs which are not adjacent to said base portion extend slightly inwardly and toward one another.

10. The coke oven door construction of claim 8 in which the ends of said first and second legs which are not adjacent to said base portion extend slightly inwardly and toward one another.

* * * * *